United States Patent [19]

Mitchell et al.

[11] 3,982,741

[45] Sept. 28, 1976

[54] OPERATING TABLE OR THE LIKE WITH GEOMETRICALLY COMPENSATED DIFFERENTIALLY MOVABLE LOAD SHARING MULTIPLE HYDRAULIC CYLINDER AND PISTON ARRANGEMENT

[75] Inventors: Larry D. Mitchell, Ballwin; Murray Q. Tanner, III, Florissant, both of Mo.

[73] Assignee: Affiliated Hospital Products, Inc., St. Louis, Mo.

[22] Filed: Mar. 25, 1975

[21] Appl. No.: 561,888

[52] U.S. Cl. ..... 269/325

[51] Int. Cl.[2] ..... A61G 13/00

[58] Field of Search ..... 269/322, 323, 324, 325; 5/62, 66–69

[56] References Cited

UNITED STATES PATENTS

| | | | |
|---|---|---|---|
| 2,092,266 | 9/1937 | Talas | 269/325 |
| 3,176,975 | 4/1966 | Burzlaff et al. | 269/325 |
| 3,206,188 | 9/1965 | Douglass | 269/325 |
| 3,281,141 | 10/1966 | Smiley et al. | 269/325 |
| 3,593,350 | 7/1971 | Knight et al. | 5/66 |

*Primary Examiner*—Al Lawrence Smith
*Assistant Examiner*—Robert C. Watson

[57] ABSTRACT

An operating table with geometrically compensated differentially movable load-sharing multiple hydraulic actuating cylinders is provided, which enables the employment of identical diametered tandem fluid connected cylinders through differential geometrical cylinder mounting and mechanical movement interconnection proportional to the cylinders' fluid-connected compression-to-tension end effective area ratio.

13 Claims, 8 Drawing Figures

A
B
B'
C
C'
H
H'
11
21
31
35
37
41
42
43
45
51
52
53
53a
53b
54
55
55a
55b
55bg
56
57
57a
57b
58
59
59a
59b
59c
60
61
70
70a
70b
70k
70m
70o
70p
70pa
70s
71
71a
71b
73
73a
73b
74
74a
75
76
FP

FP
P
L
R
80
85
88
88b
207
201
204
59
58
76
70j
70f
91
91a
91b
91r
94
203
191p
191a
191b
191
194
195
176
170f
57
57a
56
55
55a
55b
55bg
70m
70k
70p
170
170k
170m
170p
170pa
52
53
31
175
170j
B'
A
B
C
C'
H
H'

OPERATING TABLE OR THE LIKE WITH GEOMETRICALLY COMPENSATED DIFFERENTIALLY MOVABLE LOAD SHARING MULTIPLE HYDRAULIC CYLINDER AND PISTON ARRANGEMENT

This invention relates to an improved operating table or other apparatus having a movable table top section or sections or other part which is actuated by two tandem connected hydraulic cylinders, in which differential cylinder actuating movement is compensated for by differential geometrical arrangement of the actuating mechanism proportional to the differential cylinder actuating movement.

In hydraulically actuating articulatable operating table top sections, such as the leg section, or flexure of the back and seat sections, it is desirable that such sections be actuated by two hydraulic cylinders on respective opposite sides of the table, particularly if the table top is laterally tiltable as is desirable, in order to provide a desired degree of stability under load for the table top section moved thereby. While a tandem connected cylinder arrangement can be and has been previously employed, with the piston or compression end of one cylinder connected through a closed fluid connection line to the rod or tension end of the other cylinder, and in which these connected effective compression and tension piston areas at the respective piston and rod interconnected ends are equal or unity in ratio, through employment of two different diameter thus interconnected cylinders and associated pistons, this has several disadvantages, including the necessity of using different sized cylinders, with attendant normally different diametered rods and concomitant substantially different pumping forces required for opposite directions of movement. In addition, in the event that the load direction reverses, such as when the load shifts as a function of the table top section(s) movement, the required hydraulic pumping pressure will vary substantially, and if a foot pump is employed, as is a normal practice, this difference must be compensated for by the operator.

It is accordingly a feature of this invention to provide a tandem-interconnected paired actuating cylinder arrangement for table top sections or the like of operating tables or the like, in which unequal cylinder an/or cylinder rod movement is accommodated and compensated by proportionate geometrical arrangement of the cylinders and the effective geometrical actuation connecting points therefor.

It is a further feature to provide an operating table or the like, having one or more hydraulically actuated table top sections employing dual cylinder actuators, in which the cylinders are arranged in tandem with the piston or compression end of one cylinder connected through a closed fluid line to the rod or tension end of the other cylinder, and in which equal cylinder bore cross-sectional area cylinders may be employed in such arrangement, through differential ratio sizing of the respective geometrical actuation connection point spacings for the respective two cylinders, proportional to the ratio of the cylinder bore cross sectional area of the piston or compression end-interconnected cylinder relative to the difference in cross-sectional areas between the cylinder bore and rod of the rod-end interconnected cylinder, and thereby providing geometrical movement compensation for the unequal cylinder/rod movements of the two thus tandem-interconnected cylinders.

Still other objects, features and attendant advantages will become apparent from a reading of the following detailed description of an illustrative physical embodiment constructed in accordance with the invention, taken in conjunction with the accompanying drawings, wherein.

Figures 1, 2A, 2B, 3C:
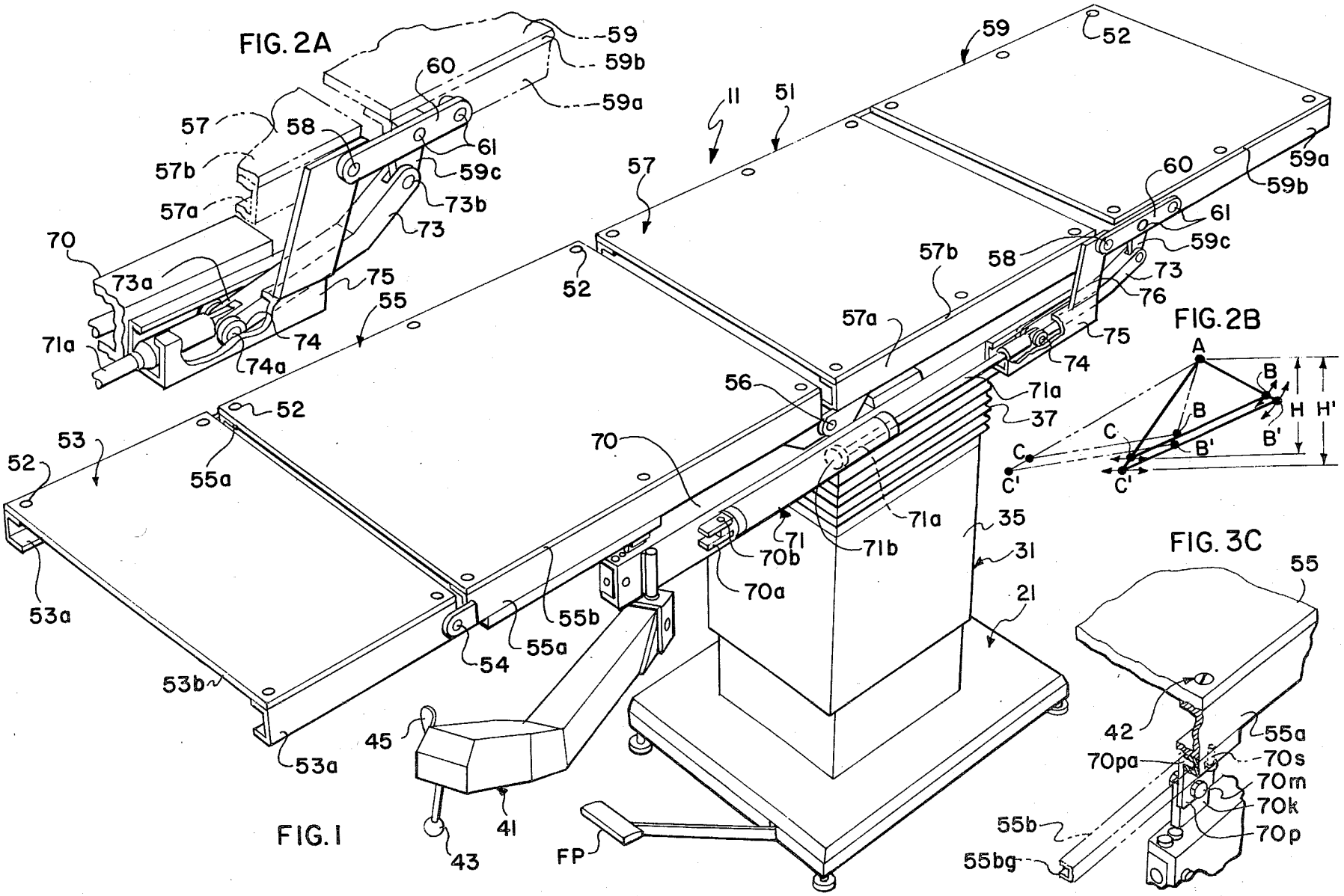
FIG. 1 is a view in perspective of an operating table constructed in accordance with the invention.
FIG. 2A is a fragmentary view of a portion of the leg section movement means.
FIG. 2B is a diagrammatic illustration of the general differential geometry for the leg section movement means.
FIG. 3C is a fragmentary view in perspective of the slide pivot mounting arrangement for the back section.

Referring now in detail to the figures of the drawings, in the illustrative embodiment an operating table 11 has a table top 51 with articulatable top sections 53, 55, 57, 59, for support of a patient. These sections are generally designated for ease and conventionality of reference, as head section 53, back section 55, seat section 57, and leg section 59, although the sections may of course accommodate a reversal of the patient or other portions of the patient's body.

The top sections 53, 55, 57, 59 are pivotally interconnected as indicated at 54, 56, 58, and suitable conventional means, not shown, may be provided to enable movement of head section 53 with and/or relative to back section 55, as desired.

The top sections 53, 55, 57, 59 are each formed of side U-channels 53*a*, 55*a*, 57*a*, 59*a*, to which panels 53*b*, 55*b*, 57*b*, 59*b* are secured as by screws 52. The top sections are carried by a pair of spaced parallel U-channel members 70, 170 which are suitably mounted on and supported by a suitably vertically adjustable pedestal 31, the construction and interconnection of which members 70 and pedestal 31 may take any conventional or desired form, and is accordingly not shown or described in detail.

Pedestal 31 may suitably have telescoping cover sections 33, 35, and a cover bellows 37, and may be supported on a base 21, which may also serve as the location for a tank reservoir R for the hydraulic actuation system later described, as well as accommodating a foot pump P, not shown in FIG. 1, which may be suitably actuated by a foot pedal FP. The table 11 may be provided with a movable control arm having a hydraulic control unit generally indicated at 41, with a table top function control handle or lever 43 and an elevate control handle or lever 45, for selected manipulation of the table top 51.

The leg section 59 is selectively pivotable upwardly and downwardly about pivot 58, by concurrent actuation of two tandem-interconnected cylinders 71, 171, on opposite sides of the table longitudinal center line. These cylinders 70 and 170 may be suitably secured at their respective piston or compression ends 71*p*, 171*p*, to the respective U-channel supports 70, 171, as by connecting pins 70*b*, 170*b* engaging with support brackets 70*a*, 170*a* fixed on the outer sides of U-channels 70 and 170.

The cylinders 71, 171 are connected through their respective rods 71*a*, 171*a* to the opposite sides of leg section 59. This connection is formed by connecting links 73, 173, extending between pivot connecting pins 74*a*, 174*a* and 73*b*, 173*b* on the ends of rods 71*a*, 171*a* and depending actuator legs 59*c*, 159*c* on leg section 59. The opposite ends of links 73, 173 may suitably take the form of a clevis, for ease of pivotal interconnection with the cylinder rods 71*a*, 171*a*, and actuator legs 59*c*, 159*c*.

The rods 71*a*, 171*a* are guided along respective straight preferably horizontal parallel paths by guide channels 75, 175, through engagement of guide rollers 74, 174 within the respective channels 75, 175, which guide rollers 74, 174 ride on pivot-connecting pins 74*a* and 174*a*. Guide channels 75, 175 may be suitably secured to the U-channel supports 70, 170 as by welding, bolts, etc. Secured to and carried by guide channels 75 are support brackets 76, 176 which form the common pivot supports for each side of the leg and seat sections 59, 57. The leg and seat sections are pivotally connected to support brackets 76, 176 as by common pivot pins 58.

Cylinders 71, 171 are fluid interconnected in tandem, with the piston or compression end 71*p* of cylinder 71 connected through a closed fluid line 83 to the rod or tension end 171*r* of cylinder 171. The rod end 71*r* of cylinder 71 and the piston end 171*p* of cylinder 171 are connected through lines 81 and 84 to a four-way control valve 87, which may take any conventional or other suitable form, and which may be actuated as by a control handle 88 through a mechanical connection 88*a*. Lines 80 and 85 connect between control valve 87 and a foot pump P and liquid reservoir R having a supply of liquid L therein.

The invention is most advantageously practiced with cylinders 71, 171 having identical bore diameters. Load output of the two cylinders must vary as the loads on the table top are not always evenly divided between the left and right sides. However, the articulated top section must be moved through the same angular rotation on both left and right sides during articulation, when loaded, etc. When the table top 51 has been positioned and the hydraulic system blocked off or closed, as by control valve 87, to support the top 51 in the selected position, loads from the patient, operating personnel, etc., will vary and also must be accommodated by the top section movement mechanism.

These requirements are satisfied by positioning the centerlines of cylinders 71, 171 parallel to one another, and by relating the dimensions of the geometrical actuation points forming triangles AB′C′, ABC proportional to the ratio of the effective compression and tension areas across the pistons 171*b*. and 71*b*. With equal diameter cylinder bores and rods 71, 171, 71*a*, 171*a* this ratio will be proportional to the ratio of the effective fluid contact piston face area on the compression side of either piston relative to the effective fluid contact piston area on the rod or tension side of the piston. Thus, for example, if this ratio is 1.1, then a ratio of 1.1 for the movement mechanism triangle AB′C′ and its various legs, relative to movement mechanism triangle ABC and its various respective legs, will accommodate the equal bore area cylinders 71, 171 and loads exerted therefrom and thereon. It is desirable that this ratio be kept as close to unity as feasible, considering the loads on rods 71*a*, 171*a*, as the closer this ratio is to unity the less will reversals of actuation or external table top loads either laterally or longitudinally be reflected as reversed differential loads into the hydraulic system. The movement mechanism triangles ABC, AB′C′ of FIG. 2B are shown in two positions of points B and C to illustrate relative movement of the parts and their pivot points B and C, and B′ and C′. Point A is formed by pivot 58 and is fixed, while points B, B′ are formed by pivot pins 73*b*, 173*b*, and points, C, C′ are formed by pins 74*a*, 174*a*.

Figures 3, 3A, 3B:
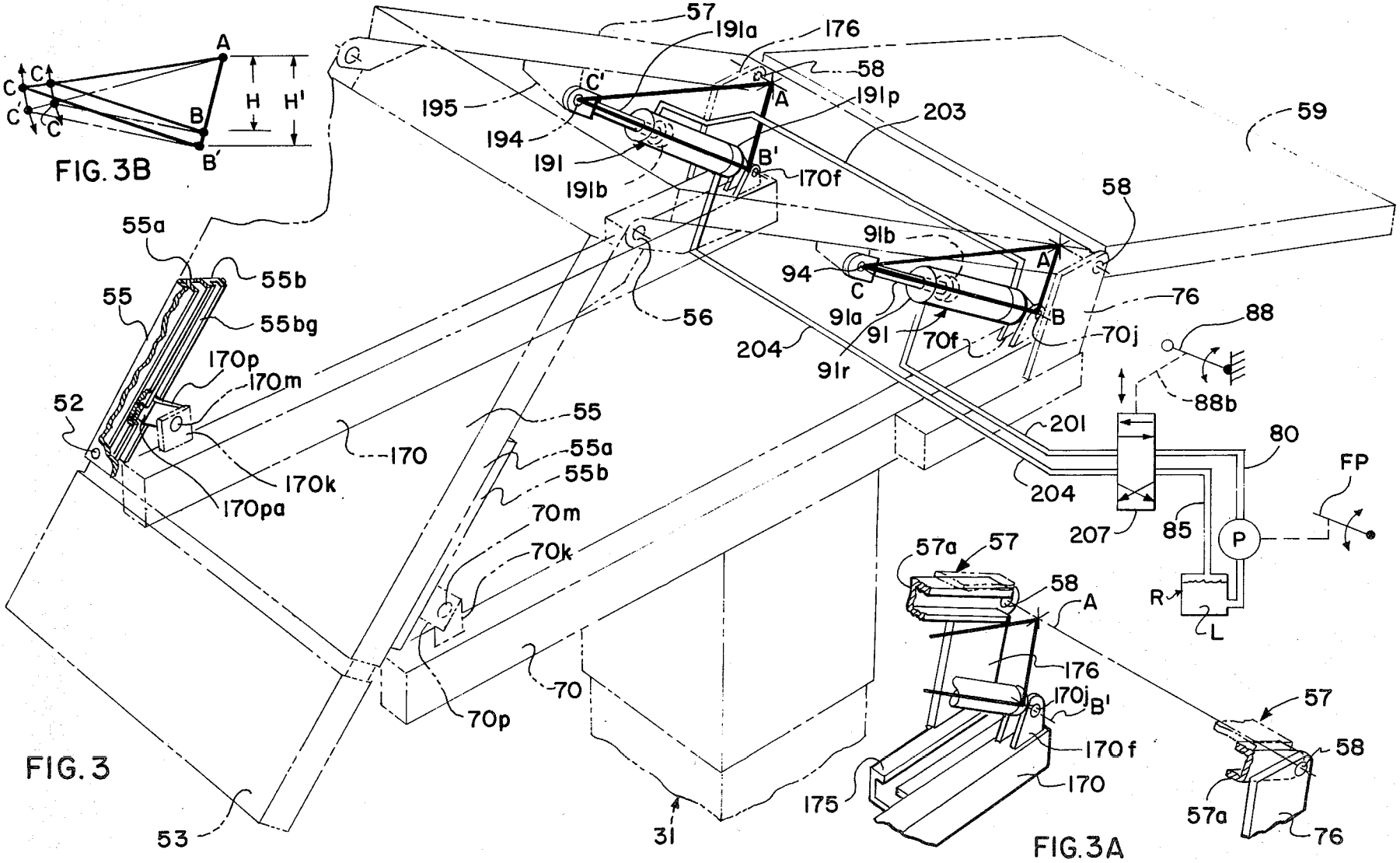
FIG. 3 is a schematic illustration of the seat and back section flex movement means, with other portions shown in phantom for clarity of illustration.
FIG. 3A is a fragmentary view of a portion of the flex movement means.
FIG. 3B is a diagrammatic illustration of the general differential geometry for the seat and back section flex movement means.

The leg section movement has been illustrated as effected through two parallel mechanisms ratioed to accommodate the differential actuating cylinders and rods 71, 71*a*, 171, 171*a*. The seat and back sections are flexed, as to the phantom line position shown in FIG. 3, by a simpler direct mechanism, in which two identical bore area cylinders 91, 191 are pivotally connected to U-channel supports 70, 170 by pins 70*j* and 170*j* and support brackets 70*f*, 170*f* on supports 70, 170. The piston rods 91*a*, 191*a* are in turn pivotally connected by pins 94, 194 to actuator leg brackets 95, 195 secured in depending relation to opposite sides of seat section 57. The two ratioed mechanism triangles are ABC, AB′C′, which are formed respectively by pivot pin 58, pivot pin 70*j* and pin 94 for triangle ABC, and pivot pin 58, pivot pin 170*j* and pin 194 for triangle AB′C′. It will be noted that in this direct cylinder actuation mechanism the point A is fixed and common, and the points B and B′ are fixed, while the points C and C′ move as a function of cylinder and rod movement to effect movement of top sections 57 and 55.

Figure 2:
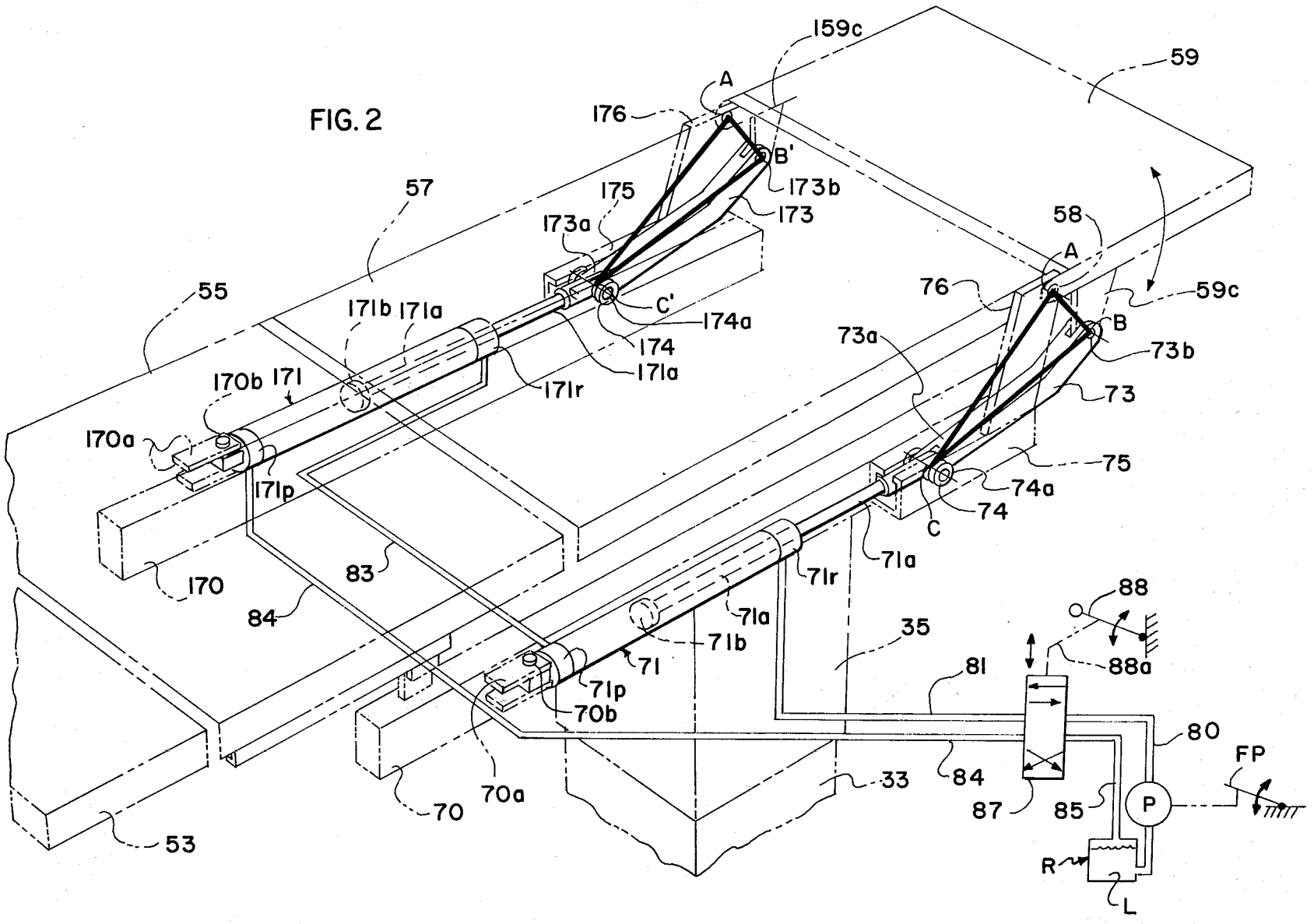
FIG. 2 is a schematic illustration of the leg section movement means of the operating table of FIG. 1, with other portions shown in phantom for clarity of illustration.

The cylinders 91, 191 are interconnected by closed line 203 as in the embodiment of FIG. 2 and the ratios of triangles ABC and AB′C′ may be similarly computed and formed by the respective mechanism pivot points.

The cylinders 91, 191 may be selectively actuated by pump P through a four-way control valve 207, lines 80, 201, 204, and 85, as in the arrangement of FIG. 2.

In order to accommodate the necessary sliding motion of back section 55 relative to its pivot support points 70*m*, 170*m* on supports 70, 170, a simple slide support pivot arrangement is provided for each side of the back section 55, as indicated at 70*k*, 70*m*, 70*p*, 55*b*, 55*bg*, and 170*k*, 170*m*, 170*p*, 55*b*, 55*bg*. These parts are respectively fixed support brackets 70*k*, 170*k*, on U-channels 70, 170, pivot pins 70*m*, 170*m*, inverted-L slide members 70*p*, 70*pa*, 170*p*, 170*pa*, fitted in sliding relation into the respective guide groove or channel 55*bg* of respective U-channel slide guides 55*b*, which in turn are secured as by securing screws 70*s* to the underside of respective U-channel members 55*a*.

By mounting the leg movement cylinders 71, 171 in parallel, and by guiding the rod end guide rollers 74, 174 along coextensive parallel paths in guide channels 75, 175, side and bending loads on rods 71*a*, 171*a* are minimized, thereby enabling the employment of minimum diameter piston rods 71*a*, 171*a* for the given anticipated axial cylinder loads, with concomitant desirably close-to-unity ratio of compression/tension effective fluid-acting areas for the cylinders 71, 171. Also, by employing paralleled straight-line arrangement of the direct acting flex cylinders 91, 191, side or bending loads on rods 91*a* and 191*a* are minimized, permitting minimum diameter rods to be employed for given anticipated axial loads.

While the invention has been described with reference to a particular illustrative embodiment, it will be apparent that various modifications and improvements may be made without departing from the scope and spirit of the invention. Accordingly, the invention is not to be limited by the particular illustrative embodiment, but only by the scope of the appended Claims.

We claim:

1. A patient supporting table or bed comprising, a table top with at least one pivotally articulatable section, support means for said top, and movement means for imparting articulated movement to said one section, said movement means comprising a pair of tandem tension-to-compression closed-fluid-interconnected laterally spaced parallel hydraulic actuating cylinders interconnected through a closed tension-to-compression fluid interconnection between the compression or piston end of one cylinder and the tension or rod end of the other said cylinder, the ratio of the interconnecting cylinder cross-section area of the piston-end-interconnected one of said cylinders relative to the (cylinder area minus rod cross section) area of the other rod-end-interconnected said cylinder at the closed tension-to-compression fluid interconnection between the compression or piston end of said one cylinder and the tension or rod end of the other said cylinder being other than unity, said cylinders being mounted and connected in pivotal-movement-imparting relation between said support and said one table top section through compensating geometrically sized linkage means in compensating differential geometrical size relation proportional to said ratio.

2. A patient supporting table or bed according to claim 1, said cylinders each being directly connected between a pair of respectively different points spaced from the common pivot axis for said articulatable section, the spacing between said points for the two said cylinders being proportional to said ratio, with the larger spacing being on the side having the tension end connection of said closed tension-to-compression interconnection.

3. A patient supporting table or bed according to claim 1, said cylinders each acting on a triangular geometric movement imparting interconnection comprising a portion of said compensating geometrically sized linkage means and being formed by three pivot axes for each triangular movement interconnection, one of said axes of each of said triangular movement interconnection being common to each said triangular movement interconnection and forming the pivot axis of said pivotally articulatable section, each of the other two of said pivot axes of the respective two triangular movement interconnections being spaced apart by a differential ratio proportional to said (cylinder cross-section area)/(cylinder area minus rod cross-section area) ratio, with the spacing between the pivots being largest on the side having the cylinder tension connection of said closed tension-to-compression fluid interconnection.

4. A patient supporting table or bed according to claim 3, the respective corresponding sides of the two said triangular movement interconnections being parallel at the various articulated positions of said articulatable table top section.

5. A patient supporting table or bed according to claim 4, said cylinders and their associated piston rods forming a leg of the respective said two triangular movement interconnections.

6. A patient supporting table or bed according to claim 4, each of said cylinders and their associated piston rods having a movement imparting pivot connection to its respective said triangular movement interconnection.

7. A patient supporting table or bed according to claim 6, said movement imparting pivot interconnections from said cylinder/rods being sliding pivot connections with respective moveable movement imparting links, each of which links forms a mutually effectively parallel leg of the respective said triangular movement interconnection.

8. A patient supporting table or bed according to claim 7, said cylinders being parallel, and respective longitudinal guide means aligned with the axis of each of said cylinders and guiding the respective said sliding pivot interconnections in alignment with the respective said cylinder.

9. Apparatus according to claim 7, said cylinders being substantially identical to each other in their respective effective cylinder and rod cross-section areas.

10. Apparatus according to claim 6, said cylinders being substantially identical to each other in their respective effective cylinder and rod cross-section areas.

11. Apparatus according to claim 3, said cylinders being substantially identical to each other in their respective effective cylinder and rod cross-section areas.

12. Apparatus according to claim 2, said cylinders being substantially identical to each other in their respective effective cylinder and rod cross-section areas.

13. Apparatus according to claim 1, said cylinders being substantially identical to each other in their respective effective cylinder and rod cross-section areas.

* * * * *